United States Patent [19]

Engebretsen

[11] 3,937,355

[45] Feb. 10, 1976

[54] REMOVABLE LINER FOR TRASH COMPACTORS

[75] Inventor: Einar O. Engebretsen, Troy, Ohio

[73] Assignee: Hobart Corporation, Troy, Ohio

[22] Filed: Mar. 6, 1974

[21] Appl. No.: 448,620

Related U.S. Application Data

[62] Division of Ser. No. 184,038, Sept. 27, 1971, Pat. No. 3,807,299.

[52] U.S. Cl. ..... 220/63 R; 220/1 T; 220/4 E; 220/65

[51] Int. Cl.[2] ..... B65D 25/14

[58] Field of Search..... 53/124 B, 255, 260, 261; 220/1 T, 4 B, 4 E, 8, 17, 63 R, 65; 229/9, 14 BE, 19, 23 A; 232/43.2; 248/95; 100/206, 224, 225, 229 A, 247, 252; 141/73, 80, 313, 314, 316, 369, 370, 390

[56] References Cited

UNITED STATES PATENTS

| | | | |
|---|---|---|---|
| 1,213,588 | 1/1917 | Cohen | 220/1 T |
| 2,322,439 | 6/1943 | Heithoff | 220/17 |
| 2,386,929 | 10/1945 | Brown | 232/43.2 |
| 3,613,566 | 10/1971 | Sharleigh, Jr. et al. | 100/229 A |
| 3,667,381 | 6/1972 | Bottas et al. | 100/229 A |
| 3,675,810 | 7/1972 | Ross, Jr. et al. | 220/65 |

FOREIGN PATENTS OR APPLICATIONS

| | | | |
|---|---|---|---|
| 120,464 | 10/1970 | Norway | 232/43.2 |
| 1,052,678 | 12/1966 | United Kingdom | 220/1 T |

*Primary Examiner*—William Price
*Assistant Examiner*—Stephan Marcus
*Attorney, Agent, or Firm*—Biebel, French & Bugg

[57] ABSTRACT

In a trash compactor which includes a ram for compacting waste materials deposited in the compactor, a two-piece, reusable liner is positioned within the compactor to receive the waste material and facilitate removal of the waste material after compaction thereof. Each of the sections is formed of a fairly rigid material, such as polyethylene, and each is provided on its outer surfaces with ribs which serve to both strengthen the liner sections and prevent the liner from sticking to the interior surfaces of the drawer. Each of these sections is constructed of intergrally formed, upstanding sidewalls and a bottom wall with one side wall of each of the sections being just high enough to retain liquids within the liner while permitting their ready assembly and disassembly.

5 Claims, 10 Drawing Figures

REMOVABLE LINER FOR TRASH COMPACTORS

This is a division of application Ser. No. 184,038, filed Sept. 27, 1971, now U.S. Pat. No. 3,807,299.

BACKGROUND OF THE INVENTION

The per capita production of waste material, particulary in the United States, has increased greatly in recent years and the problems of disposing of this increased waste material, which has been compounded by a sharp increase in population, has resulted in numerous proposals for solutions of this problem. One method proposed involves the compacting of such materials to reduce the volume thereof and thereby facilitate their disposition. In addition to compactors utilized on a more or less commercial basis, as in refuse collection trucks, other devices have been developed for use in compacting refuse at the point of origin.

Many of these units, which are typified by the home installed units, utilize disposable bags which are placed within the compactor to receive the refuse and into which the material is compacted. Such bags are generally of a special, laminated construction which incorporates layers for strength and other layers for moisture proofing. Since these bags are generally used only once they represent a continuing expense for the compactor user and possibly, detract from the acceptance of such units.

Other units of this type utilize a one-piece, more or less self-supporting container, into which the waste material is deposited and subsequently compacted. With this type of container, however, it will be seen that problems arise in removing the compacted material from the container. While tapering the container side walls may provide some alleviation of this problem, it will be seen that this results in a loss of container volume and of course, there may still be difficulty in removing the compacted materials particularly if it is wet or sticky.

SUMMARY OF THE INVENTION

The present invention comprises a compactor which utilizes a reusable, two-piece liner. The two sections which comprise the composite liner are formed of a substantially rigid, self-supporting material such as polyethlene. Each of the units includes integrally formed upstanding side walls and a bottom wall, with one side wall of each of these sections being just high enough to retain any liquids within the section but yet low enough to facilitate assembly of the sections and subsequent disassembly for removal of the compacted material therefrom.

Each of the sections also has ribs integrally formed on the outside thereof to both provide further strengthening of the unit and to prevent the sections from sticking to the interior of the drawer within which they are received. Handles are formed in each section and corresponding notches are formed in the upper edges of the side walls of the drawer so that the handles may readily be grasped when the drawer is pulled out to facilitate removal of the liner and the compacted material therein.

Because the liner is formed as two, substantially rigid sections, the compacted material is readily removed by separating the two liner sections.

DESCRIPTION OF THE PREFERRED EMBODIMENTS

Figure 1:
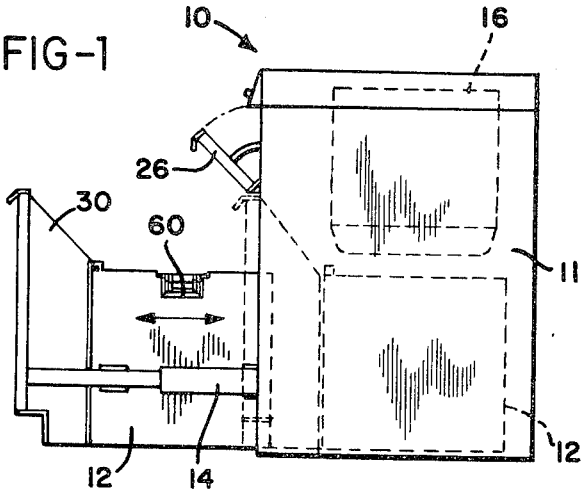
FIG. 1 is a side elevational view showing a compactor with the liner received therein.
Figure 2:
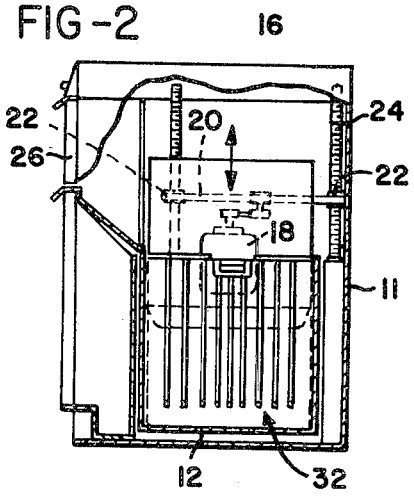
FIG. 2 is a view similar to FIG. 1 but with the drawer retracted and parts broken away for clarity.
Figure 3:
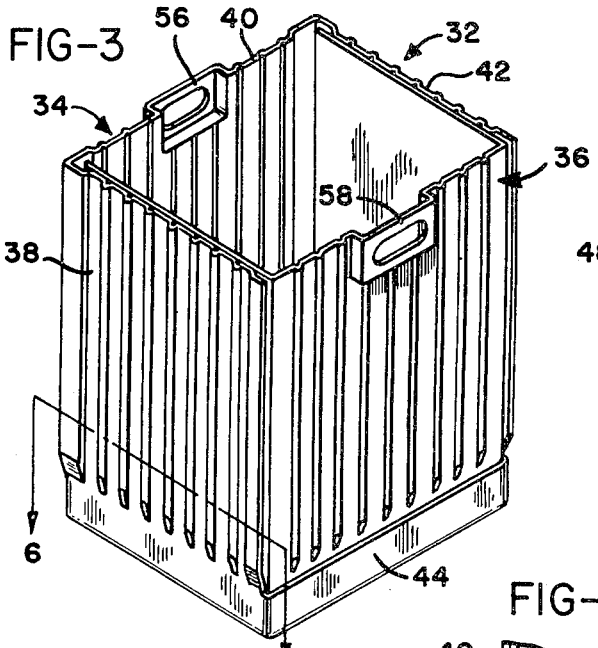
FIG. 3 is a perspective view of the assembled liner sections.
Figure 4:
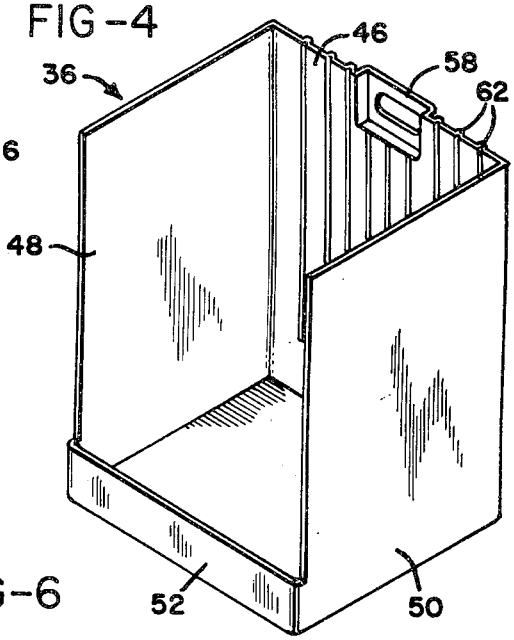
FIG. 4 is a perspective view of one of the sections shown in FIG. 3.
Figure 5:
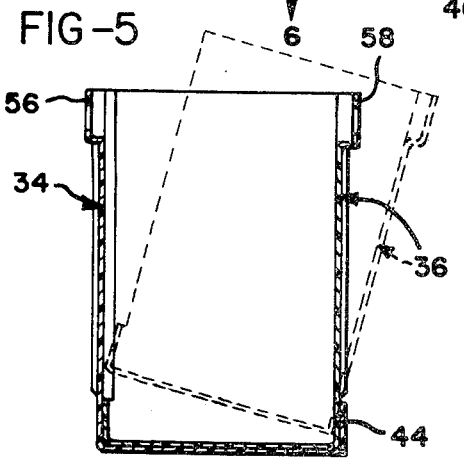
FIG. 5 is a cross-sectional view taken on line 5—5 of FIG. 3 with one section of the liner also shown in a tilted position in phantom lines.
Figure 6:
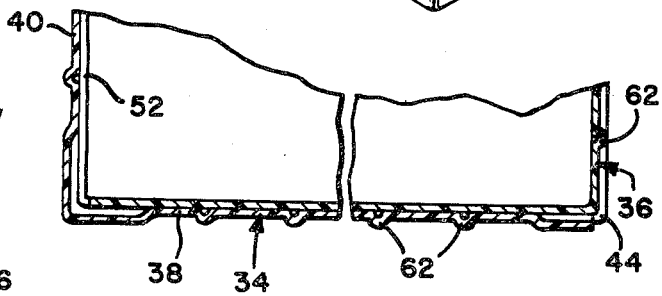
FIG. 6 is a view taken on line 6—6.

As seen in FIGS. 1 and 2 of the drawings, a compactor 10 in which the liner of the present invention finds utility may include an upstanding cabinet 11 housing a receptacle 12 in the form of a drawer slidable on rails 14 between an accessible, noncompacting position shown in FIG. 1 and a compacting position shown in FIG. 2. Housing 11 also encloses a ram 16 carrying a motor 18 and driving a chain 20. Chain 20 wraps three, triangularly disposed ball nuts 22 (only two of which are shown in FIG. 2) which threadably engage stationary screw-threaded rods 24. The housing 11 is also provided with an upper door 26, pivotally mounted to move between the positions shown in FIGS. 1 and 2. Received within the receptacle or drawer 12 is a liner 32 which, as best seen in FIGS. 3 through 6, includes a pair of cooperating sections 34 and 36. Section 34 is formed of a substantially rigid material such as polyeythlene and includes upstanding walls 38, 40, 42 and 44. Walls 38, 40 and 42 are of substantially the same height as the height of the sidewalls of the receptacle or drawer 12. Upstanding wall 44, however, is appreciably shorter than the remaining walls, as best seen in FIGS. 3 and 5 of the drawings.

The second section 36, like the first section 34, is also formed of a substantially rigid material such as polyethylene. Sections 36 also include upstanding walls 46, 48 and 50 which are substantially the same height as that of the receptacle 12. Disposed in spaced parallel relationship to the wall 46 is a second upstanding wall 52 which, as best seen in FIG. 4, is appreciably shorter than the height of the wall 46 and is approximately the same height as the height of the wall 44.

The section 36, like the section 34, is preferably molded in one piece construction with all four upstanding walls and the bottom wall 54 formed integrally with each other. It will also be noted that the liner is provided with handles 56 and 58 formed in the sections 34 and 36, respectively. Additionally, the drawer or sliding receptacle 12 is provided with a notch 60 in each of its upper edges of its sidewalls, only one of which is shown in FIG. 1, with the handles 56 and 58 aligned with and accessible through notches 60. Finally, it will be noted that each of the sections is provided with ribs 62 integrally formed on the exterior surfaces of the liner sections and extending from the tops thereof to points spaced from the bottom walls thereof.

In operation the two sections 34 and 36 are assembled, as shown in FIG. 3, and inserted in the drawer or sliding receptacle 12 with the handles thereof accessible through the notches 60 in the side walls thereof. Small articles of waste material may be deposited in the compactor by pivoting the door 26 downwardly to the position shown in FIG. 1. The smaller articles of waste material will lie on the inclined surface 30 of the drawer 12 within the compactor until such time as the drawer or receptacle 12 is moved outwardly toward the position shown in FIG. 1, at which time the articles will drop into the liner 32. Larger pieces of waste material are deposited in the liner by sliding the receptacle 12 outwardly to the position shown in FIG. 1.

After a quantity of material has accumulated in the liner the ram 16 is actuated by energizing the motor 18. This drives the chain 20 wrapping the ball nuts 22, which causes the entire unit to move downwardly on the stationary screw-threaded rods 24 and enter the liner 32 to compact the material therein. After compacting the material the ram 16 moves upwardly, permitting either more material to be placed in the liner or removal of the compacted material from a compactor. In the latter case, the drawer or receptacle 12 is again moved outwardly to the noncompacting position shown in FIG. 1 and the liner is removed therefrom by grasping the handles 56 and 58.

In this regard it should be noted that not only do the ribs 62 strengthen the liner sections but they also prevent the liner from sticking to the interior surface of the drawer. After the liner is removed from the drawer the section 36 may be tilted from the section 34 as shown in phantom lines of FIG. 5 of the drawings. It will be seen that the short wall 44 of the section 34 facilitates this operation, while the short wall 52 of the section 36 thereafter permits the ready removal of the compacted material from the liner section 36.

Usually the material will be compacted to the extent that it can be disposed of as a single mass in any collection facility. Although the walls 44 and 52 are low enough to permit the sections to be readily assembled and disassembled, they are also high enough to insure that any liquid contained in the waste material is retained in the system and does not seep down into the drawer or is otherwise spilled when the sections are separated. After cleaning, if necessary, the liner sections are reassembled to form the composite liner of FIG. 3, placed in the open drawer 12, and the drawer slid back into the housing 10 to the compacting position to repeat the operation described above.

Figure 7:
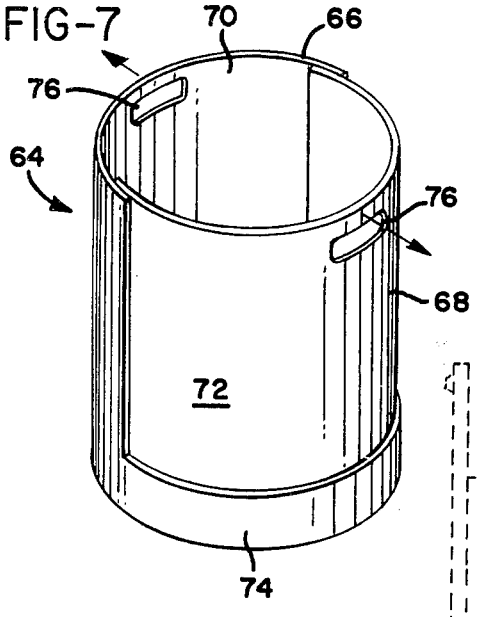
FIG. 7 is a perspective view of a composite liner of cylindrical configuration.

It will be appreciated that while a liner of substantially rectangular cross section having the upstanding walls thereof extending normal to its bottom wall will provide the greatest volume, it may be desirable in some situations to utilize a liner having a cross-sectional configuration other than rectangular. For example, if the ram of the compactor was circular in configuration it would generally be desirable to utilize a cylindrically shaped liner. This is illustrated in FIG. 7 of the drawings wherein a cylindrically shaped liner 64 is illustrated formed of two sections 66 and 68. Each of the sections includes upstanding wall portions 70 and 72, respectively, their bottom wall portions extending normally to the upstanding wall portions, similarly to the embodiment described above. Additionally, the upstanding wall portions include reduced portions, only one of which is shown at 74 although it will be appreciated that the section 72 has a similar reduced portion flanked by the full height portion 76. As in the previous embodiment, when it is desired to remove the liner from the compactor the handles 76 will be grasped and the sections moved apart in the direction indicated by the arrows.

Figure 8:
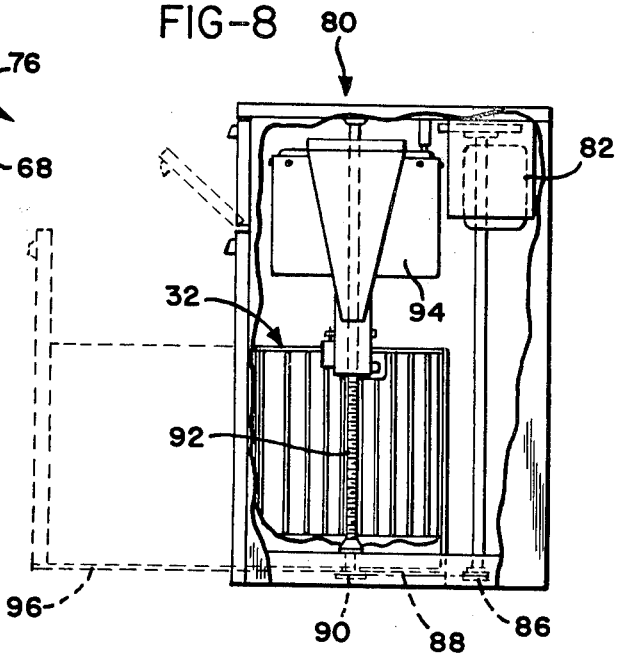
FIG. 8 is a side view similar to FIG. 1 but showing a liner in a second type of compactor.

FIG. 8 shows an additional type of compactor in which the sectional liner of the present invention finds utilization. In the compactor 80 shown in FIG. 8 of the drawings a motor 82 drives a shaft 84 having sprocket 86 mounted on the lower end thereof. Sprocket 86 drives a chain 88 which wraps a pair of sprockets, only one of which is shown at 90. Each of these sprockets 90 are fastened to the lower ends of spaced, parallel drive screws 92 mounted on opposite sides of the compactor 80. The ram 94 is provided with threaded couplings on each side thereof threadably engaging the drive screws 92 so that upon energization of the motor 82 the ram 94 is caused to move upwardly and downwardly within the compactor housing. A drawer 96, shown in dotted lines in the open position, receives the composite, two-piece liner, such as the liner 32 if the ram is of rectangular configuration.

Figure 9:
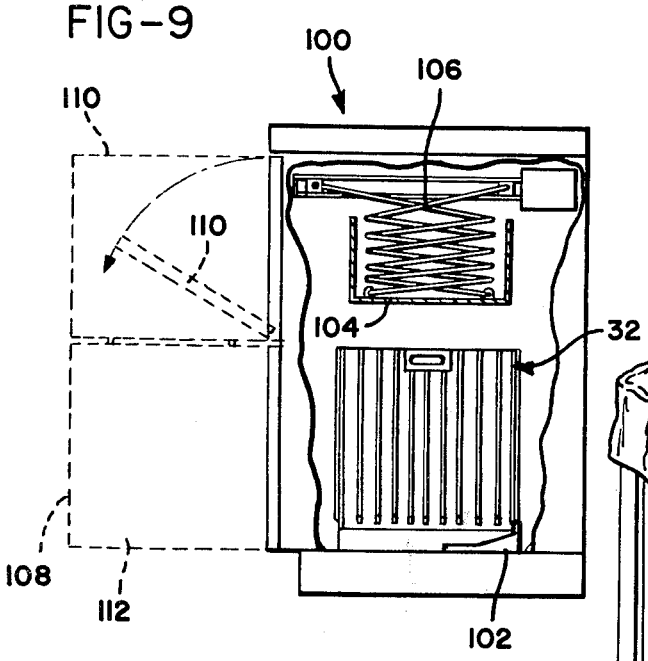
FIG. 9 is a view showing the liner of the present invention in a third type of compactor.

As noted above the composite liner of the present invention may be used in any of several different types of compactors. FIG. 9 shows still a further type of compactor which may advantageously utilize a liner, such as the liner 32 or 64. In the compactor shown in FIG. 9 a drawer for holding the liner is dispensed with and the liner merely placed in the compactor with means, illustrated somewhat diagramatically in FIG. 9 as a stop member 102, provided to position the liner within the compactor 100 correctly with respect to the ram 104. Additionally, it will be noted that the ram 104 will be powered by a scissors jack arrangement 106. It will also be noted that the door 108 to the compactor is of composite construction, including upper and lower sections 110 and 112, respectively. The two sections are hinged along one vertical edge of the compactor and may be opened together to the dotted line position shown in FIG. 9. In this position the liner, 32 in FIG. 9, but it may of course be of the type shown in FIG. 7, can be removed from the compactor, emptied and replaced. Usually, however, when it is desired to merely deposit waste materials in the liner the upper door 110 may be pivoted downwardly about its horizontal hinge connection to the lower door section 112 as shown in dotted lines and indicated by the arrow in FIG. 9 of the drawings.

Figure 10:
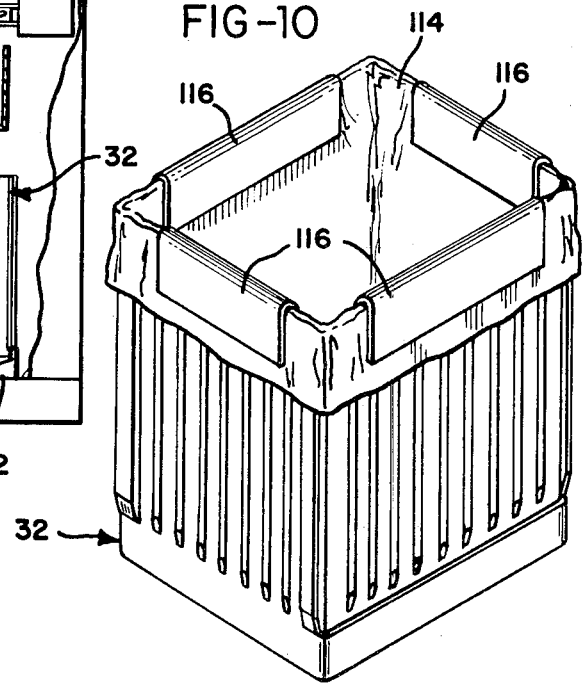
FIG. 10 is a perspective view showing the liner with a disposable bag positioned therein.

One advantage of the liner of the present invention is, of course, the fact that it is reusable and, therefore, less expensive over a period of continued use than replaceable bags. However, if the user of the compactor finds it desirable the liner of the present invention can of course be used as a support for disposable bags. Thus, as seen in FIG. 10 of the drawings, a bag 114 or other covering of flexible material may be droped over the inner surface and upper edges of the liner and, if further desired, secured in place by means such as the U-shaped clips 116. Although not affording the cost advantage gained by using the liner alone, this approach does provide the advantage, as compared to the use of bags above, in that the removal of the bags from the compactor is facilitated and the strength of the bags necessary is somewhat less than that that would be necessary if the bags were used without additional support.

From the above it will be apparent that the present invention provides a compactor utilizing a reusable liner which is substantially self-supporting and formed of separate sections to facilitate the removal of a compacted material therefrom.

While the forms of apparatus herein described constitutes preferred embodiments of the invention, it is to be understood that the invention is not limited to these precise forms of apparatus, and that changes may be made therein without departing from the scope of the invention which is defined in the appended claims.

What is claimed is:

1. A composite liner adapted to be positioned within an open-top receptacle of a trash compactor for the receipt and downward compaction of trash therein:

a. a pair of separate liner sections, b. each of said liner sections being open-topped and lidless and including a bottom wall and first and second upstanding walls, c. said first walls of each section being substantially higher than said second walls of each section, d. said bottom and upstanding walls of said liner sections being formed integrally with each other and providing substantially liquid proof containers adapted to hold liquid therein up to the level of the tops of said second walls thereof, e. one of said liner sections being smaller than the other of said liner sections, f. the smaller of said liner sections being positioned in nested but unattached relationship with the other of said liner sections with said bottom wall of said smaller section overlying and being in contact with said bottom wall of said other section, said second wall of said smaller section underlying a lower portion of said first wall of said other section and edge portions of said first wall of said other section overlapping edge portions of said first wall of said smaller section, and g. said liner sections being readily separable manually by relative tilting movement thereof to facilitate removal of trash therefrom and complete separation of each of said liner sections from the other for cleaning purposes.

2. The liner of claim 1 wherein:

a. said sections are semicylindrical in cross section.

3. The line of claim 1 wherein:

a. said bottom wall of each of said liner sections is substantially rectangular in shape, b. said second wall of each of said sections extends coextensively with one side of said bottom wall and projects substantially perpendicularly upwardly therefrom, and c. said first wall of each of said liner sections extends coextensively with the remaining three sides of said bottom wall and projects perpendicularly upwardly therefrom.

4. The liner of claim 1 further comprising:

a. means defining a plurality of ribs integrally formed on exterior surfaces of said composite liner when said sections are in said nested relationship to strengthen said composite liner.

5. The liner of claim 4 further comprising:

a. means defining handles integrally formed on each of said liner sections to permit said sections to be readily separated and facilitate the removal of compacted trash therefrom.

* * * * *